US005097233A

United States Patent [19]

Pekarek

[11] Patent Number: 5,097,233

[45] Date of Patent: Mar. 17, 1992

[54] COPLANAR 3DB QUADRATURE COUPLER

[75] Inventor: Joseph E. Pekarek, Manhattan Beach, Calif.

[73] Assignee: Hughes Aircraft Company, Los Angeles, Calif.

[21] Appl. No.: 631,806

[22] Filed: Dec. 20, 1990

[51] Int. Cl.[5] ..... H01P 5/16

[52] U.S. Cl. ..... 333/116; 333/128

[58] Field of Search ..... 333/115, 116, 127, 128

[56] References Cited

U.S. PATENT DOCUMENTS

| | | | |
|---|---|---|---|
| 2,633,531 | 3/1953 | Nelson | 333/127 X |
| 3,089,103 | 5/1963 | Oliner | 333/127 X |
| 3,742,392 | 6/1973 | Schwarzmann | 333/128 |

FOREIGN PATENT DOCUMENTS

| | | | |
|---|---|---|---|
| 2170358 | 7/1986 | United Kingdom | 333/128 |

*Primary Examiner*—Paul Gensler

*Attorney, Agent, or Firm*—Leonard A. Alkov; Wanda K. Denson-Low

[57] ABSTRACT

A low loss coplanar waveguide 3dB power divider is described having high isolation between the output ports and low VSWR at the input port when used in a balanced circuit configuration. The power divider includes a 50 ohm coplanar waveguide input line and two 50 ohm coplanar waveguide output lines. The output lines are matched to the input line by 71 ohm quarter wavelength sections of coplanar waveguide lines. One output line is a quarter wavelength longer than the other. A quarter wavelength slot is cut in the input line center conductor, and a resistor is defined at the juncture of the input and output lines. Reflected power that would normally travel out the input port is terminated in the resistor.

11 Claims, 4 Drawing Sheets

COPLANAR 3DB QUADRATURE COUPLER

BACKGROUND OF THE INVENTION

The present invention relates to power divider circuits, and more particularly to a low loss coplanar waveguide power divider circuit.

Known power dividers that provide low VSWR in coplanar waveguide balanced circuits rely on a Lange coupler type of configuration. A coplanar 90° Lange coupler is an interdigital planar coupler, as described in "Interdigitated Coplanar Directional Couplers," E. M. Bastida, N. Fanelli, 1980 Electronics Letters, pages 645–646; "Interdigitated Stripline Quadrature Coupler," Julius Lange, IEEE Trans. MTT-IT, No. 12, 1150–1151, Dec. 1969. The disadvantage of the Lange coupler is that it has relative high loss.

Another type of 3 dB coupler is a Wilkinson coupler with one output a quarter of a wavelength longer than the other output. The 90° Wilkinson is made by connecting an extra quarter wave length long (at center frequency) section of transmission line to the Wilkinson divider. Wilkinson couplers are described in "Microwave Circuit Analysis and Amplifier Design," S. Y. Liao, Prentice-Hall, Inc., Englewood Cliffs, N.J., 1987. However, this type of circuit is limited to microstrip implementations.

There is a need for a low loss coplanar waveguide 3 dB power divider for use in balanced circuits, and particularly such a power divider that has high isolation between output ports and low VSWR at the input port.

SUMMARY OF THE INVENTION

It is therefore an object of this invention to provide a low loss coplanar waveguide power divider that has high isolation between output ports and low VSWR at the input ports when used in a balanced circuit configuration.

These and other objects are provided by a power divider in accordance with the present invention, which comprises a coplanar waveguide input line and two coplanar waveguide output lines. One output line has an effective electrical length which is a quarter wavelength longer than the other output line. The input and output lines are characterized by substantially equal characteristic impedances. The circuit further includes two quarter wavelength coplanar waveguide lines which match the output lines to the input lines, meeting the input line to form a T-shaped junction.

In accordance with the invention, a quarter wavelength slot is formed in the center conductor of the input line, terminating at a resistor element load located at the junction.

In operation, the input power divides evenly between the two output lines. In a balanced circuit configuration any power reflected at the output ports will arrive at the junction 180° out-of-phase. The slot causes the center conductor of the input line to behave as a quarter wavelength section of balanced coplanar strips shorted on one end. The slot is made sufficiently narrow such that most of the reflected power sees an open circuit and is terminated in the resistive load.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
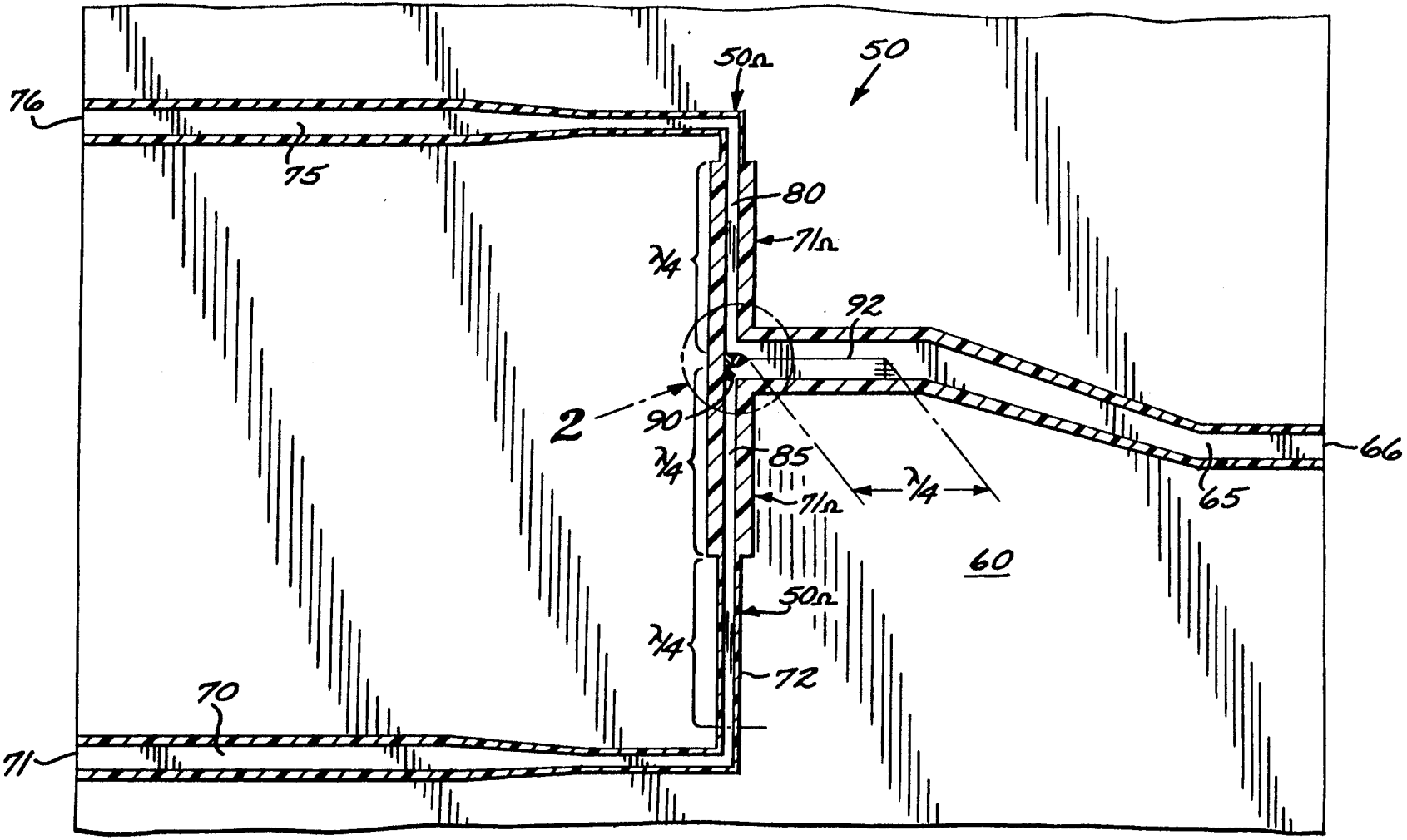
FIG. 1 illustrates a preferred embodiment of a coplanar waveguide 3 dB quadrature coupler embodying the invention.

An exemplary embodiment of a quadrature coupler 50 embodying the invention is shown in FIG. 1, illustrating a top view of a patterned conductive surface 60 formed on an underlying dielectric substrate. In FIG. 1, the entire surface 60 is conductive, formed by a thin layer of gold or other conductive material deposited on the dielectric substrate except in the cross-hatched areas, which designate areas in which the conductive layer has been selectively removed to define the circuit elements. Exemplary substrates suitable for the purpose are manufactured by the Hybrid Products Division, Materials Research Corporation, Orangeburg, N.Y. 10962; a preferred material is 25 mil thick alumina.

The circuit 50 includes one 50 ohm input line 65 and two 50 ohm output lines 70 and 75. The lines 65, 70 and 75 are each fabricated as coplanar waveguide transmission lines. Thus, as is known to those skilled in the art, the characteristic impedance of the coplanar waveguide transmission line is determined by the width of the center conductor and the size of the gap between the center conductor and the adjacent ground plane.

In the exemplary embodiment of FIG. 1, the output lines 70 and 75 are matched to the input line 65 with 71 ohm quarter wave sections 80 and 85 of coplanar waveguide. Sections 80 and 85 are defined by coplanar waveguide transmission lines having a 71 ohm characteristic impedance, and which have a length equal to one quarter of a wavelength at the band center frequency.

The impedance looking into sections 80 and 85 from the junction of sections 80 and 85 will be 100 ohms for each line. The parallel combination of sections 80 and 85 will result in an impedance of 50 ohms. The 100 ohm impedance looking into sections 80 and 85 is achieved via the use of respective quarter wave transformer sections 80 and 85.

The impedance $Z_o$ of each section 80 and 85 required to obtain the 100 ohm impedance looking into these sections 80 and 85 can be found from the following formula for $Z_L$, representing the combined impedance of the respective section 80 or 85, and the transmission line 70 or 75 of characteristic impedance $Z_s = 50$ ohms.

$$Z_L = Z_o^2 / Z_s \quad (1)$$

$$Z_o=(Z_L Z_s)^{\frac{1}{2}}=(50(100))^{\frac{1}{2}}=71 \text{ ohms} \quad (2)$$

Output line 70 is a quarter wavelength longer than the other output line 75 at the band center frequency.

Figure 2:
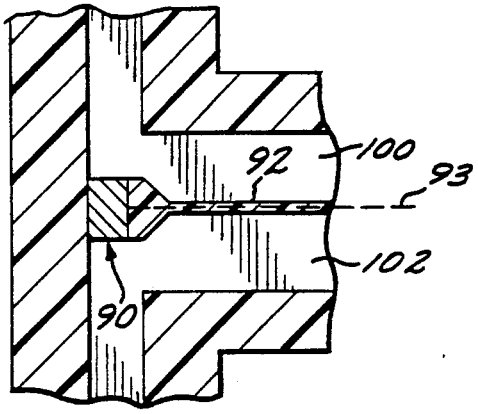
FIG. 2 is an enlarged view of the portion of the circuit 50 indicted by phantom circle 2 of FIG. 1, showing in enlarged view the resistor element comprising the circuit.

As shown in further detail in FIG. 2, the circuit 50 further includes a 200 ohm distributed resistor 90 connected at the junction of the line 65 and sections 80 and 85. A nonconductive slot 92 is defined in the center conductor 65 by removing the conductive layer 60, thereby forming conductive strips 100 and 102. In this embodiment, the 200 ohm resistor 90 is formed by laser-trimming the resistor material, a thin film sheet resistance that is deposited on the substrate underneath the conductive layer 60. The resistor 90 is formed by selectively etching the conductive layer 60 off the resistive material with a chemical process. The value of the resistor 90 is determined from a consideration of the device operation explained in further detail below.

The input port 66 of the circuit 50 is taken at the input line 65; the respective output ports 71 and 76 are taken at the respective output lines 70 and 75 as shown in FIG. 1.

Figure 3:
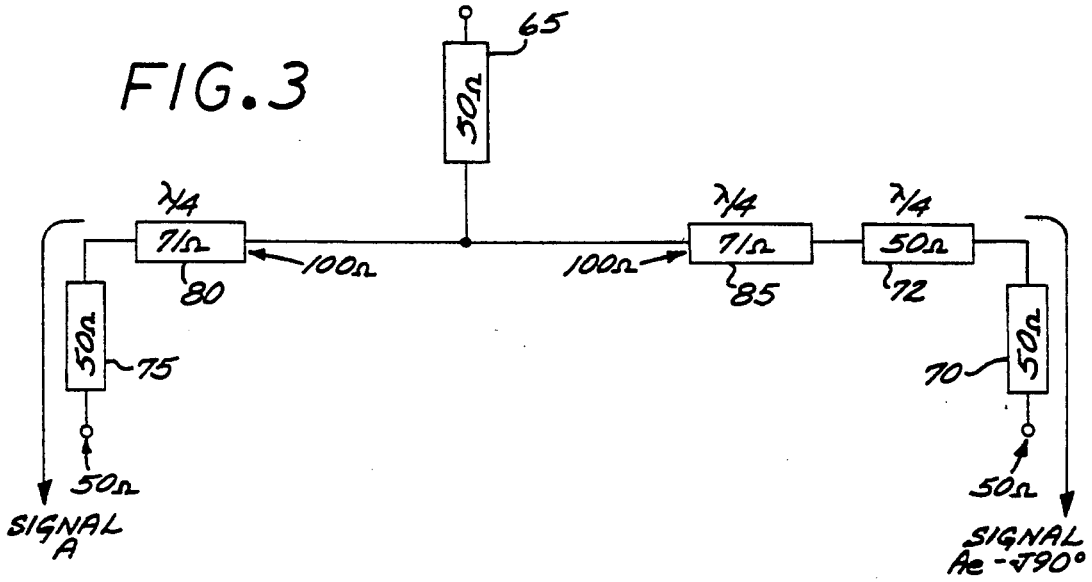
FIG. 3 is a schematic diagram of the effective electrical circuit of the coupler of FIG. 1 as presented to an input signal to the coupler.

The operation of the circuit 50 will now be explained with reference to FIGS. 3 and 4. An effective schematic diagram of the circuit 50 as seen by an input signal of power 2A is shown in FIG. 3. The input signal power is split between the two output lines 70 and 75, with the signal divided into output line 75 represented as signal A, and the signal divided into the output line 70 being delayed by 90° and represented as $A_e^{-j90°}$. The distributed resistor 90 has no effect on the input signal. This is because the electric potential on the conducting strips 100 and 102 on either side of slot 92 (FIG. 2) will be the same for any mirrored set of points that fall on the conducting strips, where the mirror plane includes the center line 93 of slot 92 and is perpendicular to the plane of the substrate. For a signal incident from line 65, this results from the symmetry of the section of line that includes slot 92. Since the electrical potential is the same on either side of slot 92 for a wave incident from line 65, the electric potential at either end of resistor 90 will also be the same. Hence, the voltage across resistor 90 will be zero for a signal incident from line 65, and no power of the incident input signal will be dissipated in it.

Figure 4:
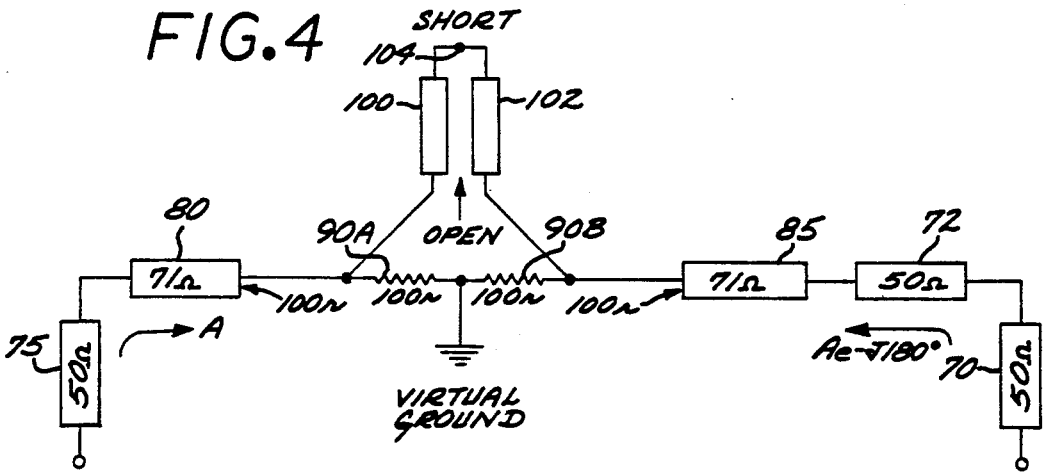
FIG. 4 is a schematic diagram of the effective electrical circuit of the coupler of FIG. 1 as presented to reflected signals.

Now consider the effect of equal reflections of the input signal from the output ports 71 and 76, as illustrated in the effective schematic diagram of FIG. 4. The respective reflected signals will arrive at the junction of the line 65 and the sections 80 and 85 180° out-of-phase, since the signal through output line 70 will have traversed the quarter wavelength section 72 twice. At this point, the resistor 90 appears as respective 100 ohm resistors 90A and 90B. The two signals that are incident on resistor 90 from sections 80 and 85 are 180° out-of-phase, so they may be represented by signal B incident from 80 and signal −B incident from 85. If B is defined as the voltage of the signal, then the voltage across resistor 90 will be given by $V_R=B-(-B=2B$. Without loss of generality, the resistor 90 can be defined to be the equivalent resistors **90*a* and 90*b* in series (100 ohm +100 ohm =200 ohm). The voltage at the connection of 90A and 90B can then be found from simple voltage division to be 0 volts for any value of B. Since a node at 0 volts can be considered a virtual ground, resistor 90 is equivalent to resistors 90*a* and 90*b* connected to ground. The 100 ohm equivalent resistance to ground is chosen as 100 ohms in order to match the impedance looking into sections 80 and 85, which are both 100 ohms. This will maximize the power transfer of the signal from sections 80 and 85 into the resistors 90*a* and 90*b*. In order for the resistors 90*a* and 90*b* to be matched to sections 80 and 85, line 65 must appear as an open circuit. Line 65** can be made to look like an open circuit as follows.

The slot 92 causes the center conductor 65 to behave as a quarter wavelength section of balanced coplanar strips 100 and 102 (similar to twin lead transmission line) shorted on one end 104. The slot 92 is made as narrow as is possible with the chemical etch process that is used to define the slot. The width is typically about 1 mil. The slot 92 is made as narrow as possible in order to make the two strips 100 and 102 appear as a transmission line with as low as possible characteristic impedance. If the two strips are of low impedance then most of the energy that is incident from the junction of 80, 85 and 65 into line 65 will be confined in the region of the slot 92. The length of the slot 92 is determined to be the length of one-quarter wave length long section of slotline (as described in "Microstrip Lines and Slotlines, K. C. Gupta et al., Artech House, Mass., 1979, at pages 204–207) at a frequency equal to center frequency of the power divider. A quarter wave section of transmission line terminated in a short circuit will present an open circuit to an incident signal. If the slot 92 is made to be very narrow, most of the reflected power that would normally travel out the input port 66 will see an open circuit, and the power reflected from ports 71 and 76 will be terminated in the 100 ohm resistors 90A and 90B.

An exemplary prototype circuit as shown in FIG. 1 was tested over a 10% bandwidth centered at 9.56 Ghz. The loss of the coupler was less than 0.2 dB. The input return loss was greater than 25 dB with the outputs terminated in 50 ohms. The isolation between the outputs was greater than 18 dB. The input return loss with the outputs open circuited was greater than 10 dB.

The 3 db power divider in accordance with the invention is characterized by low loss and low VSWR, and is well suited for use in a balanced circuit configuration, such as a balanced low noise amplifier where loss is critical.

Figure 5:
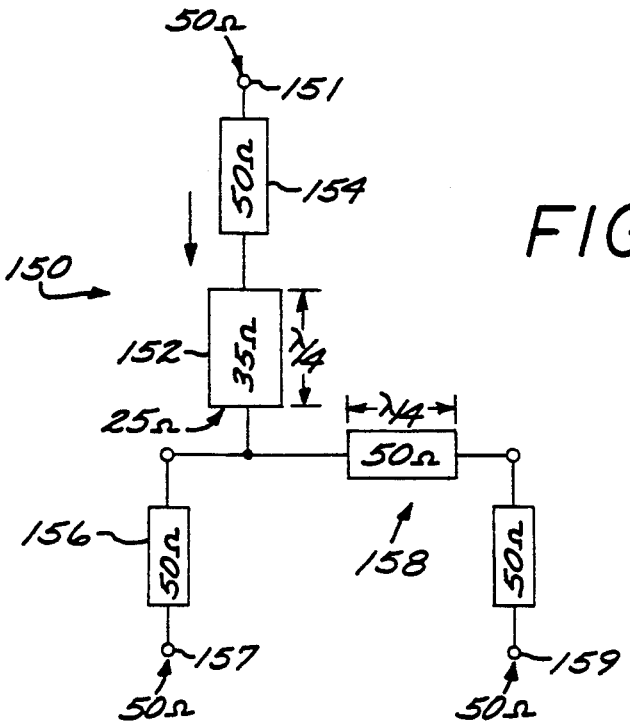
FIGS. 5 and 6 illustrate an alternate embodiment of a coplanar quadrature coupler in accordance with the invention.
Figure 6:
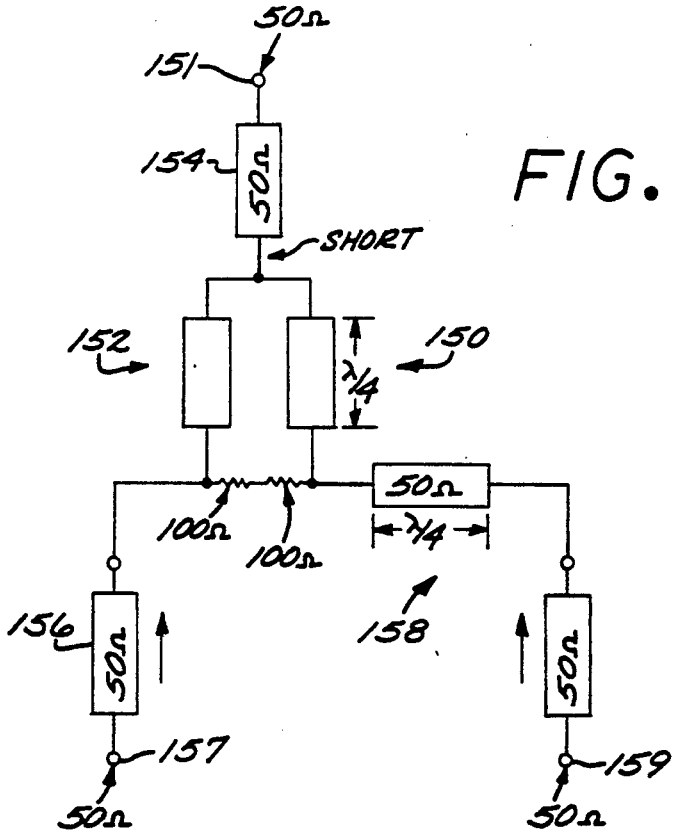

It is understood that the above-described embodiments are merely illustrative of the possible specific embodiments which may represent principles of the present invention. Other arrangements may readily be devised in accordance with these principles by those skilled in the art without departing from the scope and spirit of the invention. For example, the alternate circuit 150 of FIGS. 5 and 6 is constructed and operates in a similar manner as the circuit 50 of FIGS. 3 and 4, including a quarter-wavelength slot similar to slot 92 (FIG. 1), except the impedance matching is accomplished with a single one-quarter wave section 152 of 35 ohms at the input (at the band center frequency) as shown. FIG. 5 shows the circuit 150 as seen by an input signal incident at input port 151. FIG. 6 shows the circuit 150 as seen by the signals reflected from the output ports 157 and 159. The output lines of circuit 150 differ in length by one-quarter wavelength, as in the circuit 50. The 35 ohm section 152 matches the input line 154 to the parallel combination of the two 50 ohm output lines 156 and 158 (50 ohms in parallel with 50 ohms =25 ohms). This configuration 150 has the advantage of being physically smaller than the circuit embodiment of FIGS. 3 and 4. In this embodiment, the slot is (analogous to slot 92 of FIG. 1) formed in the center conductor of the section 152.

Figure 7:
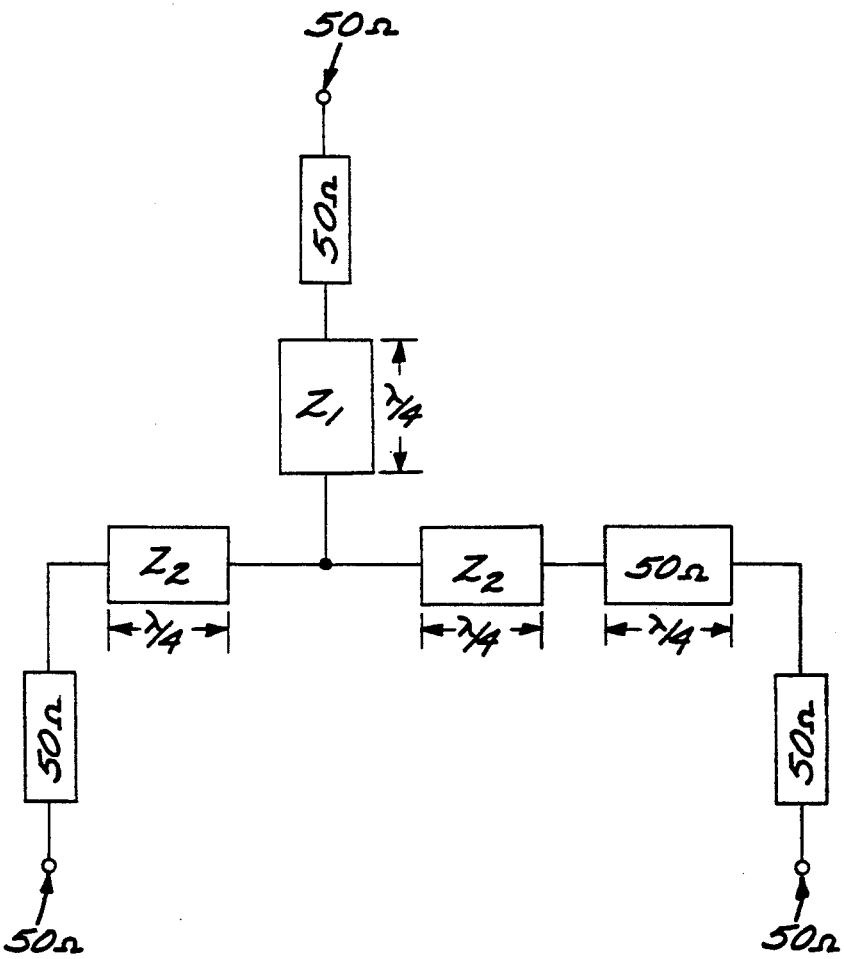
FIG. 7 illustrates a second alternate embodiment of a coplanar quadrature coupler in accordance with the invention.

A third embodiment is illustrated in FIG. 7 and is a combination of the first two embodiments, where the quarter wave impedance sections $Z_1$ and $Z_2$ can be adjusted to provide a two section quarter wave match as described in "Foundations of Microwave Engineering," R. E. Collins, McGraw Hill, 1966, at pages 221–237. This embodiment also employs a quarter-wave slot similar to slot 92 of FIG. 1. The values used for $Z_1$ and $Z_2$ will determine the extent and shape of the frequency response of the device. The advantage of this configuration is a larger bandwidth. Collins, id., describes both a binomial transformer and a Chebyshev transformer. Both are applicable to this device. In this case, the 50 ohm characteristic impedance ($Z_L$) of the input line is to be matched to the impedance ($Z_o$) of the parallel combination of the output lines of the 50 ohm characteristic impedance. That is, an impedance of 50 ohms is to be matched to an impedance of 25 ohms. In a general sense, two quarter-wave impedance transformers $Z_a$ and $Z_b$ are being use to transform from 50 ohms to 25 ohms. The first transformer $Z_a$ is $Z_1$ of FIG. 7. The second $Z_b$ is the combination of the two $Z_2$ quarter-wave elements, one in each output branch, and so $Z_2=2Z_b$. To find the values of $Z_1$ and $Z_2$ which provide the match for 50 ohms to 25 ohms, the values of $Z_a$ and $Z_b$ for either the binomial or Chebyshev transformer can be calculated as described in Collins, id., at pages 227–237. The value for $Z_1$ (FIG. 7) is set equal to $Z_a$, and the value for $Z_2$ (FIG. 7) is set equal to $2Z_b$.

What is claimed is:

1. A coplanar waveguide power divider circuit defined on a dielectric substrate, comprising:

a coplanar waveguide input line comprising a center conductor and a first characteristic impedance;

first and second coplanar waveguide output lines, each comprising a center conductor and having a characteristic impedance substantially equal to said characteristic impedance of said input line, the first output line having an electrical length which is a quarter wavelength longer than the second output line;

means for impedance matching said output lines to said input line;

said input line and said first and second output lines being coupled together at a junction;

a quarter wavelength slot defined in the center conductor of said input line leading to the junction of said input line and said output lines, said slot terminating in a resistive element disposed at said junction;

wherein substantially none of the power incident on said power divider circuit via said input line is dissipated in said resistor device, and substantially all of the power reflected at the device output ports back into the circuit is dissipated in said resistor element.

2. The circuit of claim 1 wherein said resistive element comprises a layer of resistive material deposited on said substrate at said junction, and is electrically coupled on opposite sides thereof to said center lines of said output lines.

3. The circuit of claim 1 wherein said impedance matching means comprises first and second impedance matching coplanar waveguide line sections, each connected in series with one of said output lines and having a effective electrical length of one quarter wavelength at the center frequency of operation of said circuit, and a characteristic impedance selected so that the parallel combination of the series connection of the respective output and impedance matching sections is substantially equal to said characteristic impedance of said input line.

4. The power divider circuit of claim 3 wherein said characteristic impedance of said input line is 50 ohms, and said characteristic impedance of said impedance matching line sections is substantially 71 ohms.

5. The power divider circuit of claim 1 characterized in that the characteristic impedance of said input and output lines is 50 ohms.

6. The power divider circuit of claim 1 wherein said impedance matching means comprises a section of coplanar waveguide transmission line coupling said input line to said junction, said section having an electrical length equal to one quarter wavelength at the center frequency of operation and a characteristic impedance which is intermediate the characteristic impedance of said input line and the equivalent impedance of the parallel connection of said output lines.

7. The power divider circuit of claim 6 wherein said characteristic impedance of said input line is 50 ohms, and said characteristic impedance of said impedance matching section is 35 ohms.

8. A coplanar waveguide power divider circuit defined on a dielectric substrate, comprising:

a coplanar waveguide input line comprising a first input line section comprising a center conductor and characterized by a first characteristic impedance, said first section transitioning to a second input line section comprising a center conductor and characterized by a second characteristic impedance;

first and second coplanar waveguide output lines, each comprising a first output line section comprising a center conductor and characterized by a characteristic impedance equal to said characteristic impedance of said first section of said input line, each respective first section transitioning to a second section comprising a center conductor and characterized by a third characteristic impedance;

said second sections of said respective input and said first and second output lines being coupled together at a junction and being further characterized by electrical lengths which are a quarter wavelength long at the center frequency of operation of the circuit, said second sections comprising a means for impedance matching said first sections of said output lines to said first section of said input line;

said first section of said second coplanar waveguide output line being characterized by an electrical length which is a quarter wavelength longer at said center frequency than the electrical length of said first section of said first coplanar waveguide output line; and a quarter wavelength slot defined in the center conductor of said second section of said input line leading to said junction, said slot terminating in a resistive element disposed at said junction;

wherein substantially none of the power incident on said power divider circuit via said input line is dissipated in said resistor device, and substantially all of the power reflected at the device output ports back into the circuit is dissipated in said resistor element.

9. The circuit of claim 8 wherein said resistive element comprises a layer of resistive material deposited on said substrate at said junction, and is electrically coupled on opposite sides thereof to said center conductors of said output lines.

10. The circuit of claim 8 wherein said characteristic impedance of said first sections of said input and output lines is 50 ohms.

11. The circuit of claim 8 wherein said the respective characteristic impedances of said respective second sections of said input and output lines are selected so that said respective second sections form a two section quarter wave matching circuit.

* * * * *